US006019672A

United States Patent [19]

Damgaard

[11] Patent Number: 6,019,672

[45] **Date of Patent: *Feb. 1, 2000**

[54] GRINDING/POLISHING COVER SHEET FOR PLACING ON A ROTATABLE GRINDING/POLISHING DISC

[75] Inventor: Morten Damgaard, Frederiksberg C, Denmark

[73] Assignee: Struers A/S, Rodovre, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 08/640,813

[22] PCT Filed: Mar. 28, 1995

[86] PCT No.: PCT/DK95/00134

§ 371 Date: May 8, 1996

§ 102(e) Date: May 8, 1996

[87] PCT Pub. No.: WO96/07508

PCT Pub. Date: Mar. 14, 1996

[30] Foreign Application Priority Data

Sep. 8, 1994 [DK] Denmark ..... 1036/94

[51] Int. Cl.[7] ..... B24D 3/02

[52] U.S. Cl. ..... 451/527; 451/529

[58] Field of Search ..... 451/529, 534, 451/537, 536, 527, 530, 921, 41, 285, 287, 288, 290

[56] References Cited

U.S. PATENT DOCUMENTS

| | | |
|---|---|---|
| 3,913,279 | 10/1975 | Broïdo . |
| 4,162,899 | 7/1979 | Molnar et al. . |

FOREIGN PATENT DOCUMENTS

| | | |
|---|---|---|
| 2226068 | 8/1974 | France . |
| 2438486 | 2/1976 | Germany . |
| 2856391 | 7/1980 | Germany . |
| 1326383 | 8/1973 | United Kingdom . |
| 1403167 | 8/1975 | United Kingdom . |
| 1441899 | 7/1976 | United Kingdom . |
| 2094824 | 9/1982 | United Kingdom . |

*Primary Examiner*—Robert A. Rose

*Attorney, Agent, or Firm*—Watson Cole Grindle Watson, P.L.L.C.

[57] ABSTRACT

A grinding/polishing cover sheet for placing on a rotatable grinding/polishing disc (3) consists of a thin foil (1), to which a coating (2) of a hard composite material has been applied through a stencil with or without an associated serigraphic membrane. The foil (1) is stiff in its own plane, but flexible perpendicularly thereto. The composite layer may consist of a matrix of artificial resin with one or more substances embedded therein, e.g. particles of one or more metals or ceramic materials, or fibers or particles of synthetic substances or graphite. The foil can be held in position on the grinding/polishing disc (3) by magnetism or by glueing.

9 Claims, 2 Drawing Sheets

GRINDING/POLISHING COVER SHEET FOR PLACING ON A ROTATABLE GRINDING/POLISHING DISC

BACKGROUND OF THE INVENTION

1. Field of the Invention

The invention relates to a grinding/polishing cover sheet for placing on a rotatable grinding/polishing disc, particularly for the treatment of materialographic samples.

2. The Prior Art

The treatment of materialographic samples in a grinding/polishing machine is usually performed in three steps, viz. a plane grinding step, a fine grinding step and a polishing step, but according to circumstances one or more intermediary steps may be interposed.

The cover sheets employed today are usually not in themselves used for grinding, but serve as a substrate for a grinding/polishing agent, which is sprayed or otherwise applied to the surface of the cover sheet, either automatically or manually. During the grinding a lubricant may also be applied. The grinding grains employed may, e.g., be diamonds, aluminum oxide or silicon carbide of different fineness for the different steps.

Grinding/polishing cover sheets are known which have a surface layer consisting of a cloth of textile fabric or woven or non-woven synthetic fibres, cf. FR 2226068. The cloth serves as a substrate for a grinding/polishing agent and may on its rear side have an adhesive layer with a detachable protective layer, so that it can be glued directly to the surface of a grinding/polishing disc, or the cover sheet may comprise additional layers including e.g. a supporting foil with an adhesive layer.

Cover sheets of the kind described have the advantage that they are cheap to manufacture and easy to handle, so that they may be used over and over again, until they have been worn out, and can thereafter be discarded without substantial loss. They have, however, the disadvantage that they have a soft surface so that the samples can press themselves into the surface layer, whereby the edges of the samples are rounded, and a relief pattern is formed between different phases of different hardness in the surface, which is in many cases not acceptable.

It is also known to use hard coatings consisting of a composite material, e.g., of epoxy with particles of one or more metals or ceramic materials embedded therein. In the prior art, cf., e.g., DK 143096, such coatings are moulded on or glued to a self-supporting rigid plate, e.g., in the form of mutually separated segments, whereafter the surface of the coating is straightened by turning and/or grinding. In this manner a tool is formed, which can be mounted as grinding/polishing disc in a grinding/polishing machine.

In the use of such a tool the hard surface of the coating material is non-uniformly worn, the wear being greatest adjacent the center and decreasing towards the periphery. Thereby the surface of the coating will gradually assume a concave shape, which results in obliquity of the surfaces of the samples. When the obliquity reaches a certain maximum permissible limit value, the surface of the coating can be straightened anew by a turning and/or grinding operation, and this can be repeated several times, but each time it is a cumbersome and time consuming operation which interferes disturbingly with the progress of the work and thereby impairs productivity. When renewed straightening of the coating is no longer possible, the tool must be discarded in its entirety, whereby a substantial initial expense is lost.

It is the object of the invention to provide a grinding/polishing cover sheet by which the drawbacks of the previously known systems are avoided.

SUMMARY OF THE INVENTION

With this object in view, a grinding/polishing cover sheet according to the invention is characterized in that the grinding/polishing face of the sheet is constituted by the surface of a coating consisting of a hard composite material which is suitable as a substrate for a grinding/polishing agent, and which is applied through a stencil with or without an associated serigraphic membrane to a supporting layer consisting of a foil which has a sufficient stiffness in its own plane to prevent crumpling of the cover sheet under the influence of the tangential grinding/polishing resistance, combined with a sufficient flexibility perpendicularly to its own plane to ensure plane contact of the supporting layer with the surface of the grinding/polishing disc under the influence of the axial grinding/polishing pressure.

The composite layer can advantageously consist of a polymerizable material, which is applied to the supporting foil in viscous or pulverulent form and is caused to polymerize on the surface of the foil with or without heating through the foil.

A coating applied in the manner set forth will, when properly executed, have a thickness so uniform that when the foil is pressed into plane contact with the hard surface of the grinding/polishing disc, the surface of the coating will with great accuracy become parallel to the surface of the grinding/polishing disc, which can be presumed to be accurately plane and perpendicular to the axis of rotation in the whole lifetime of the disc, since it is not subjected to wear. Moreover, owing to the hardness of the coating, materialographic samples are prevented from pressing themselves into the surface of the coating, so that rounding of the edges of the samples, and the formation of a relief pattern between different phases of different hardness in the surfaces of the samples are avoided. Since the thickness of the coating can be held within fractions of a mm, preferably within the limit values 0.05–1.0 mm, and a supporting foil having the requisite flexibility will also have a relatively small thickness, for metal foils, e.g., of the same order of size as the coating, a cover sheet according to the invention can be manufactured at low cost and with a small consumption of materials.

The coating will, like in the known systems, be subjected to non-uniform wear, viz. heaviest adjacent the center and decreasing towards the periphery. When the wear has proceeded to a point where the coating has been completely worn off adjacent the center, or the tolerance limit for obliquity of the samples has been reached, the coating is held to be worn out. It can, however, now be discarded and replaced by a new one without substantial loss of initial expense. The replacement does not give rise to disturbance of the progress of the work, and a high productivity can therefore be achieved in the materialographic treatment of samples.

BRIEF DESCRIPTION OF THE DRAWINGS

The invention will now be described in further detail with reference to the drawing, in which.

DETAILED DESCRIPTION OF THE PREFERRED EMBODIMENT

Figure 1:
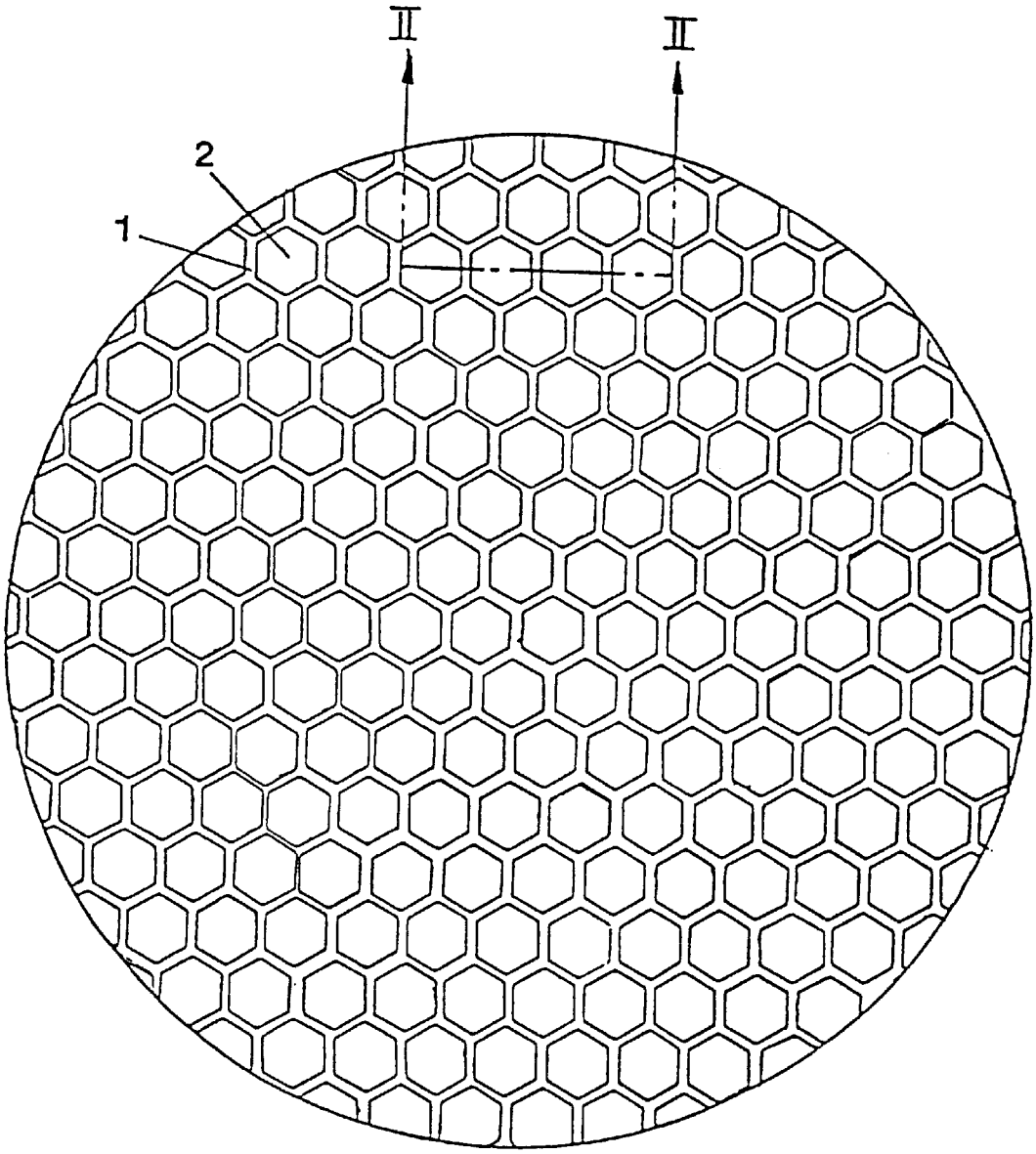
FIG. 1 is a top view of a grinding/polishing cover sheet according to one embodiment of the invention.
Figure 2:
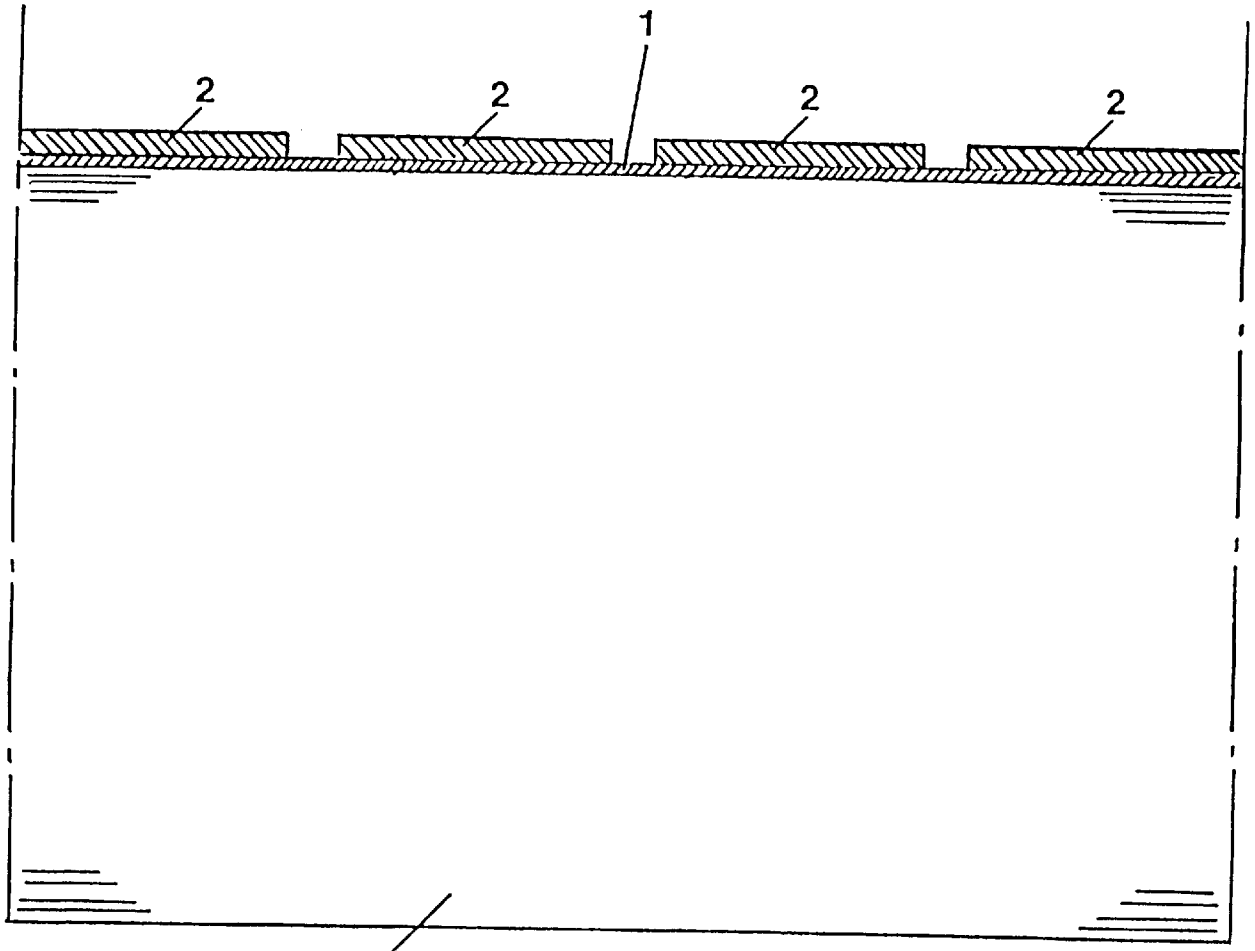
FIG. 2 is a section along the line II—II in FIG. 1, on a larger scale.

FIG. 1 shows a foil 1 to which a coating has been applied in a pattern consisting of separate segments 2. In FIG. 2 the cover sheet thereby formed is shown to be placed on a grinding/ polishing disc 3. The segments are shown as being hexagonal, but can also have another configuration, e.g., square.

Instead of being subdivided into segments, the coating may be in the form of a continuous layer. In that case, an annular stencil is used which delimits the area of the coating. For most fields of use, however, a construction with separate segments is preferred, because a network of channels is formed between the segments, capable of accommodating and disposing of grinding chips and detached grinding grains.

In making a cover sheet with a coating subdivided into segments, the coating is applied to the foil through a mask-like stencil subdividing its area into separate segments, with or without an underlying serigraphic membrane.

The foil 1 should have a sufficient stiffness in its own plane to prevent crumpling of the cover sheet under the influence of the tangential grinding/polishing resistance, and besides it should be sufficiently flexible perpendicularly to its own plane to be urged into plane contact with the surface of the grinding/polishing disc under the influence of the axial grinding/polishing pressure. The foil may preferably consist of metal, e.g., tin plate, Cu, Al, with a thickness of the order of 0.05–1.0 mm, but it is also possible to use a non-metallic foil fulfulling the specified conditions, e.g., consisting of fibre, hard plastics, cardboard, impregnated paper, impregnated tissue, e.g., non-woven.

The composite material used as coating material has a hardness such that the materialographic samples cannot during the treatment press themselves into the surface of the coating, whereby a rounding of the edges of the treated samples, and the formation of a relief pattern between different phases of different hardness in the surface are avoided.

The composite material can advantageously consist of a matrix of an artificial resin, such as epoxy, polyurethane, polyester, acryl, with one or more non-grinding admixtures embedded therein.

By selecting different matrix materials and admixtures it is possible to produce a selection of coatings which are suitable for a variety of grinding/polishing jobs.

The admixtures may, e.g., be particles of one or more metals, e.g., Fe, Sn, Al, Cu and/or ceramic materials, or they may be fibres or particles of non-metallic materials, such as acryl, polyester, teflon, acetate or other materials used in non-woven products.

In general, hard admixtures such as cast iron or ceramic materials are preferable for use in the grinding/polishing of hard materials, while soft admixtures, such as acryl polyester or graphite are preferable for use in the grinding/ polishing of soft materials.

The foil serving as supporting sheet may, as mentioned, advantageously consist of a metal. When using soft iron or another material with high magnetic permeability, in combination with a permanently magnetized grinding/polishing disc, the exchange from step to step in the treatment can take place by peeling-off the cover sheet from the disc and replacing it by another, and each of the cover sheets can be separately re-used until they are worn out, and can then be discarded.

If cover sheets with foils without magnetic properties are used, the foil may be provided on its rear side with an adhesive layer with a detachable protective layer. In that case it is practical to use a plurality of grinding/polishing discs to which the cover sheets are attached by adhesion and remain so attached until they are worn out. The exchange from step to step then takes place by exchange of grinding/ polishing disc, and only when a cover sheet has been worn out it is removed from the grinding/polishing disc and replaced by a new one. This procedure is somewhat more cumbersome.

Seeing that, as previously mentioned, the wear to which the surface of a grinding/polishing cover sheet is subjected is greatest ajacent the center and decreases towards- the periphery, it is possible, according to the invention, to obtain a certain prolongation of the lifetime by constructing the composite layer with concentric zones of different wear resistance, the wear resistance being greatest adjacent the center and decreasing towards the periphery.

In making such a cover sheet the application of the coating to the foil must take place in two or more steps with composite materials of different wear resistance and with different stencils, similarly as in multi-colour printing. In the innermost area immediately around the center, where the wear is at its maximum and the efficiency is low, the composite layer can be entirely omitted.

A still further prolongation of the lifetime of the cover sheet can be obtained, according to the invention, by so constructing it that, in the state in which the cover sheet is delivered, the thickness of the coating is greater adjacent the center than adjacent the periphery, the deviation lying within a limit value ensuring plane shape of the treated surface of the samples within a predetermined tolerance.

In this case, too, the application of the coating to the foil must take place in two or more steps with different stencils. When using such a cover sheet, its surface will initially be slightly convex within the permissible limits. After a certain amount of wear the surface will first become plane, and thereafter the use of the cover sheet can be further continued until its surface assumes a concave shape with the same difference of height as between center and periphery as in the initial convex shape, only with opposite sign.

It has been found that for typical materialographic grinding/polishing jobs the tolerance for obliquity of the surfaces of the samples can suitably be fixed at 0.13 mm. Thus, in an embodiment of the cover sheet according to the invention the composite layer may, in the state in which the cover sheet is delivered, have a thickness of 0.27 mm adjacent the periphery and 0.4 mm adjacent the center.

For special grinding/polishing jobs it may, however, be desirable to fix a lower tolerance, e.g., down to 0.05 mm, while for other jobs, where the requirements in respect of planar shape of the treated surfaces are not high, the tolerance can be fixed at a higher value, d.v.s., up to 0.2 mm.

The diameter of the cover sheet is selected in accordance with the diameter of the grinding/polishing disc for which it is intended to be used, and may typically lie within the range of 25–400 mm.

What is claimed is:

1. A cover sheet for a rotatable disc that can be used to surface treat workpieces, said cover sheet consisting of (1) a first planar supporting layer in the form of a flexible metal foil and second layer of segments of a hard non-grinding material applied through a stencil on a surface of the supporting layer.

2. A cover sheet as defined in claim 1, wherein the second layer has a thickness of 0.05–1.0 mm.

3. A cover sheet as defined in claim 1, wherein the non-grinding material consists of a matrix of synthetic resin and one or more non-grinding materials embedded therein.

4. A cover sheet as defined in claim 3, wherein the matrix consists of epoxy, polyurethane, polyester or acryl.

5. A cover sheet as defined in claim 3, wherein the materials embedded in the matrix comprise particles of a material selected from the group consisting of Fe, Sn, Al, Cu and ceramic.

6. A cover sheet as defined in claim 3, wherein the materials embedded in the matrix are non-metallic materials selected from the group consisting of acryl, polyester and graphite.

7. A cover sheet as defined in claim 1, wherein the second layer defines concentric zones of different wear resistance, the wear resistance being greatest adjacent the center and decreasing towards the periphery.

8. A cover sheet as defined in claim 1, wherein the thickness of the second layer is greater adjacent a center thereof than adjacent a periphery, the deviation lying within a limit value ensuring plane shape of treated surfaces of the workpieces within a predetermined tolerance.

9. A cover sheet as defined in claim 1, wherein said first layer is composed of a metal selected from the group consisting of tin plate, copper and aluminum.

* * * * *